US010569312B2

(12) United States Patent
Haremaki et al.

(10) Patent No.: US 10,569,312 B2
(45) Date of Patent: Feb. 25, 2020

(54) EXCESS SPRAYED COATING REMOVAL DEVICE, SHIELD PLATE, AND SHIELD UNIT

(71) Applicant: SUGINO MACHINE LIMITED, Uozu, Toyama Prefecture (JP)

(72) Inventors: Hiroki Haremaki, West Bloomfield, MI (US); Shunji Otani, Toyama (JP); Seiko Kinoshita, Uozu (JP)

(73) Assignee: SUGINO MACHINE LIMITED, Uozu (JP)

( * ) Notice: Subject to any disclaimer, the term of this patent is extended or adjusted under 35 U.S.C. 154(b) by 578 days.

(21) Appl. No.: 15/189,759

(22) Filed: Jun. 22, 2016

(65) Prior Publication Data

US 2017/0203339 A1 Jul. 20, 2017

(30) Foreign Application Priority Data

Jan. 15, 2016 (JP) ..... 2016-006588

(51) Int. Cl.
*B08B 9/08* (2006.01)
*B05B 12/16* (2018.01)
(Continued)

(52) U.S. Cl.
CPC ..... *B08B 9/0813* (2013.01); *B05B 12/16* (2018.02); *B05B 12/32* (2018.02);
(Continued)

(58) Field of Classification Search
CPC ..... B08B 9/0813; B08B 17/00; B05B 12/16; B05B 12/32; B05B 13/0636; C23C 4/18; F02F 7/0043; F02F 2200/00
(Continued)

(56) References Cited

U.S. PATENT DOCUMENTS 3,994,310 A * 11/1976 Brandon ..... B05B 3/06 134/167 C
4,043,295 A * 8/1977 Speck ..... B05B 3/02 118/317
(Continued)

FOREIGN PATENT DOCUMENTS

EP 2848324 A1 * 3/2015
JP 2008-303439 A 12/2008
(Continued)

OTHER PUBLICATIONS

Sumiyoshi, Toru; "Cleaning Apparatus", Nov. 2011, JP 2011-230118 Machine Translation (Year: 2011).*

*Primary Examiner* — David G Cormier
*Assistant Examiner* — Thomas Bucci
(74) *Attorney, Agent, or Firm* — Oliff PLC

(57) ABSTRACT

An excess sprayed coating removal device for removing excess sprayed coatings adhering to the inner surface of a crank chamber of a multi-cylinder engine includes: a rotatable nozzle inserted in a first small chamber, movable in a direction parallel to the axial direction of a cylinder bore communicating with the first small chamber, and jets high-pressure water toward the leading end side thereof; and at least a single of shields that are each inserted into a second small chamber adjacent to the first small chamber to face into a communication hole, the shields protecting from the high-pressure water a sprayed coating sprayed on the inner surface of the cylinder bore communicating with the second small chamber. The shields have a block portion in a region facing into the communication hole, the block portion configured to shut the high-pressure water jetted from the nozzle and passes through the communication hole.

17 Claims, 6 Drawing Sheets

(51) Int. Cl.

| | |
|---|---|
| ***B05B 13/06*** | (2006.01) |
| ***C23C 4/18*** | (2006.01) |
| ***B05B 12/32*** | (2018.01) |
| ***B08B 17/00*** | (2006.01) |
| *F02F 7/00* | (2006.01) |

(52) U.S. Cl.
CPC ..... *B05B 13/0636* (2013.01); *B08B 17/00* (2013.01); *C23C 4/18* (2013.01); *F02F 7/0043* (2013.01); *F02F 2200/00* (2013.01)

(58) Field of Classification Search
USPC ..... 134/167 R, 172, 99.1; 118/504, 317, 118/505, 300, 306, 301, 318; 427/236, 427/282, 105; 123/193.2
See application file for complete search history.

(56) References Cited

U.S. PATENT DOCUMENTS 5,468,295 A * 11/1995 Marantz ..... B05B 7/0861 118/300
5,573,814 A * 11/1996 Donovan ..... C23C 4/16 427/448
5,691,004 A * 11/1997 Palazzolo ..... C23C 4/02 427/236
5,707,693 A * 1/1998 Vliet ..... B05B 7/224 219/76.15
5,796,064 A * 8/1998 Rice ..... B05B 7/224 219/121.47
6,395,090 B1 * 5/2002 Shepley ..... B05B 12/20 118/504
6,572,704 B2 * 6/2003 Keller ..... C23C 4/16 118/504
7,555,837 B2 * 7/2009 Sugiyama ..... B05B 13/0285 29/888.061
8,500,907 B2 * 8/2013 Bohnheio ..... B05B 12/18 118/720
2002/0172769 A1 * 11/2002 Herber ..... C23C 4/16 427/271
2006/0026830 A1 * 2/2006 Boehm ..... B24C 1/06 29/888.061
2006/0172066 A1 * 8/2006 Takahashi ..... C23C 4/16 427/236
2008/0017159 A1 * 1/2008 Bohnheio ..... B05B 12/20 123/193.2
2009/0029060 A1 * 1/2009 Kanai ..... C23C 4/12 427/446
2013/0000550 A1 * 1/2013 Brown ..... C23C 4/00 118/301
2014/0008453 A1 * 1/2014 Vijay ..... B05B 1/083 239/4
2014/0165807 A1 * 6/2014 David ..... B05B 13/0636 83/177
2015/0231672 A1 * 8/2015 Haremaki ..... B08B 3/02 134/172

FOREIGN PATENT DOCUMENTS

JP 2008303439 A * 12/2008 ..... B08B 9/00
JP 2011-230118 A 11/2011
JP 2011230118 A * 11/2011 ..... B08B 3/02
JP 2015-058479 A 3/2015

* cited by examiner

EXCESS SPRAYED COATING REMOVAL DEVICE, SHIELD PLATE, AND SHIELD UNIT

BACKGROUND

1. Field of the Invention

The present invention relates to an excess sprayed coating removal device which removes excess sprayed coatings adhering to the interior of a crank chamber of an engine, and a shield plate and a shield unit which are used as part of the excess sprayed coating removal device.

2. Description of the Related Art

There have been known aluminum cylinder blocks in which an iron-based sprayed coating is formed in a cylinder bore. When the sprayed coating is formed in the cylinder bore, the sprayed coating also adheres to the interior of a crank chamber. Since the sprayed coating adhering to the interior of the crank chamber is unnecessary, it is necessary to remove the sprayed coating (hereinafter referred to as the excess sprayed coating). A method for removing excess sprayed coatings adhering to the interior of the crank chamber by using the water jet from a water injection nozzle is disclosed for example in Japanese Unexamined Patent Application Publication No. 2008-303439.

The water injection nozzle disclosed in the Japanese Unexamined Patent Application Publication No. 2008-303439 is equipped with a first injection port of low-pressure injection, the first injection port provided on the leading end side thereof and a second injection port of high-pressure injection. This water injection nozzle is configured such that a water curtain is formed by the low-pressure injection from the first injection port and the excess sprayed coatings are removed by the high-pressure injection from the second injection port. According to the Japanese Unexamined Patent Application Publication No. 2008-303439, the water curtain formed by the low-pressure injection functions to inhibit the high-pressure injection water from being directed toward a sprayed coating formed in the cylinder bore, thereby preventing the sprayed coating from peeling off.

Meanwhile, in a configuration in which high-pressure water is jetted in a direction (horizontal direction) perpendicular to the axial direction of the nozzle, such as disclosed in the Japanese Unexamined Patent Application Publication No. 2008-303439, since the inner surface of the crank chamber of the cylinder block has recesses and protrusions, the high-pressure water fails to impinge on the recesses of the crank chamber.

SUMMARY

Unfortunately, the Japanese Unexamined Patent Application Publication No. 2008-303439 removes incompletely the excess sprayed coatings adhering to the recesses of the crank chamber.

The problem can be addressed by slightly inclining the direction of the high-pressure water jet from the nozzle toward the tip relative to the horizontal direction.

However, if the injection direction of the nozzle is inclined toward the tip relative to the horizontal direction, the following new problem arises.

That is, the crank chamber is formed with, for example, a plurality of small chambers partitioned by partition walls for each cylinder bore, and the partition walls are each provided with a communication hole for equalizing the pressure in the crank chamber when a piston reciprocates. Thus, if the injection direction of the nozzle is inclined toward the tip, a new problem arises in that the high-pressure water jetted from the nozzle passes through the communication hole and impinges on the adjacent cylinder bore, resulting in peeling-off of the sprayed coating formed in the adjacent cylinder bore.

Accordingly, the present invention has been made in order to address the above-mentioned problem, and an object of the present invention is to provide an excess sprayed coating removal device which is capable of more reliably removing excess sprayed coatings adhering to the interior of a crank chamber of an engine while preventing sprayed coatings formed in cylinder bores from peeling off, and a shield plate and a shield unit which are used as part of the excess sprayed coating removal device.

In order to achieve the above-mentioned object, according to a typical aspect of the present invention, there is provided an excess sprayed coating removal device for removing excess sprayed coatings adhering to an inner surface of a crank chamber of a multi-cylinder engine, the multi-cylinder engine having: a plurality of cylinder bores arranged in an in-line or horizontally opposed configuration; and the crank chamber where a plurality of small chambers are formed by partitioning an interior of the crank chamber using a single or a plurality of partition walls for each of the cylinder bores, the multi-cylinder engine being configured such that the adjacent small chambers communicate with each other through a communication hole provided in each of the partition walls. The excess sprayed coating removal device includes: a rotatable nozzle that is inserted in a first small chamber among the plurality of small chambers, movable in a direction parallel to an axial direction of the cylinder bore communicating with the first small chamber, and jets high-pressure water toward a leading end side thereof; and at least a single of shields that are each inserted into a second small chamber adjacent to the first small chamber among the plurality of small chambers so as to face the communication hole. The shields each protect from the high-pressure water a sprayed coating sprayed on an inner surface of the cylinder bore communicating with the second small chamber. The shields each have a block portion in a region facing the communication hole, the block portion shutting the high-pressure water that is jetted from the nozzle and passes through the communication hole.

According to an aspect of the present invention, it is possible to more reliably remove excess sprayed coatings to the interior of a crank chamber of an engine while preventing sprayed coatings formed in cylinder bores from peeling off. It should be noted that the problems, constitutions, and advantages other than the above will become apparent in the following description of embodiments.

BRIEF DESCRIPTION OF THE DRAWINGS

Non-limiting and non-exhaustive embodiments of the present embodiments are described with reference to the following figures, wherein like reference signs refer to like parts throughout the various views unless otherwise specified.

DETAILED DESCRIPTION

First Embodiment

Figure 1:
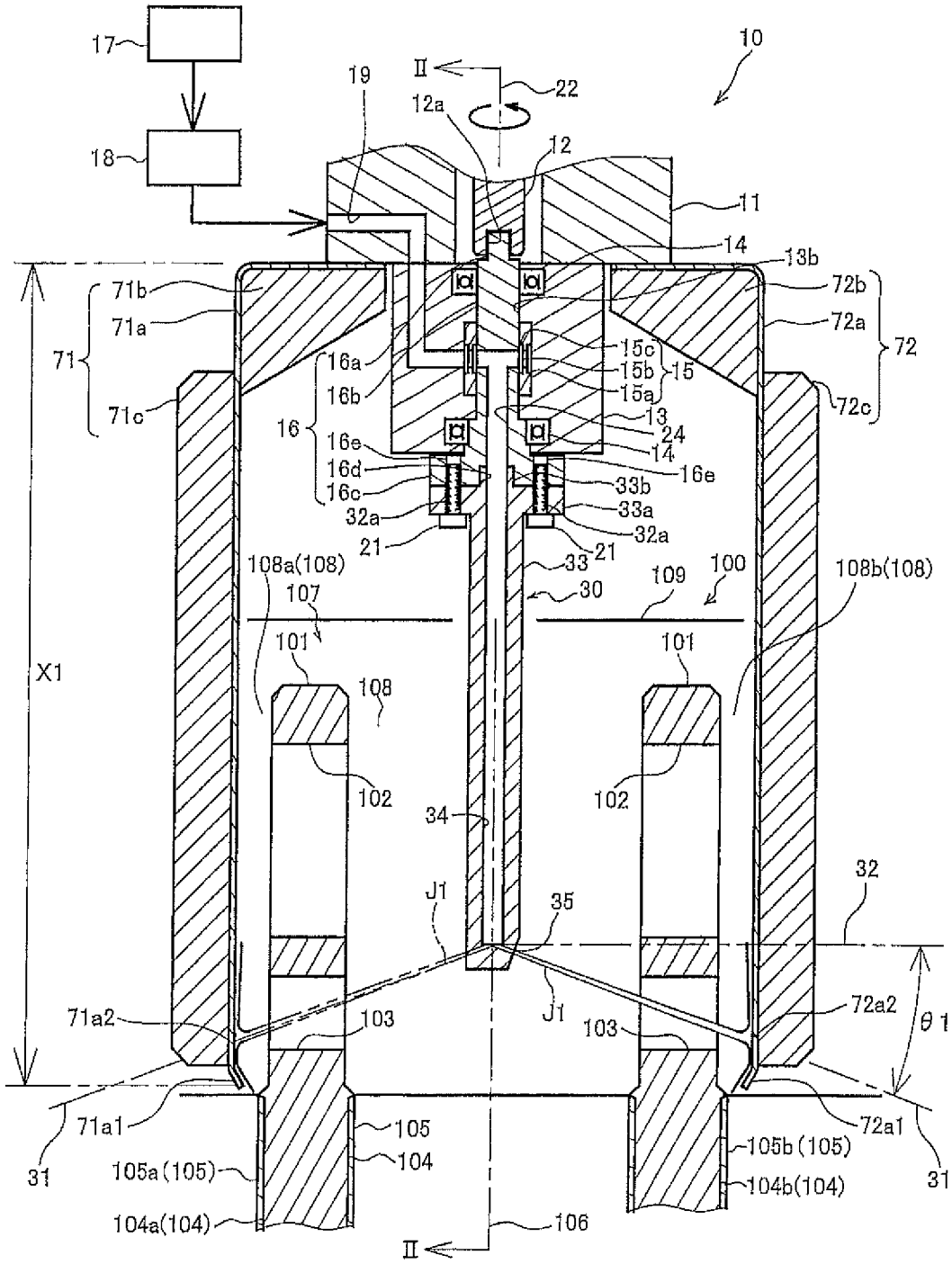
FIG. 1 is a sectional view showing the overall configuration of an excess sprayed coating removal device according to a first embodiment of the present invention.
Figure 2:
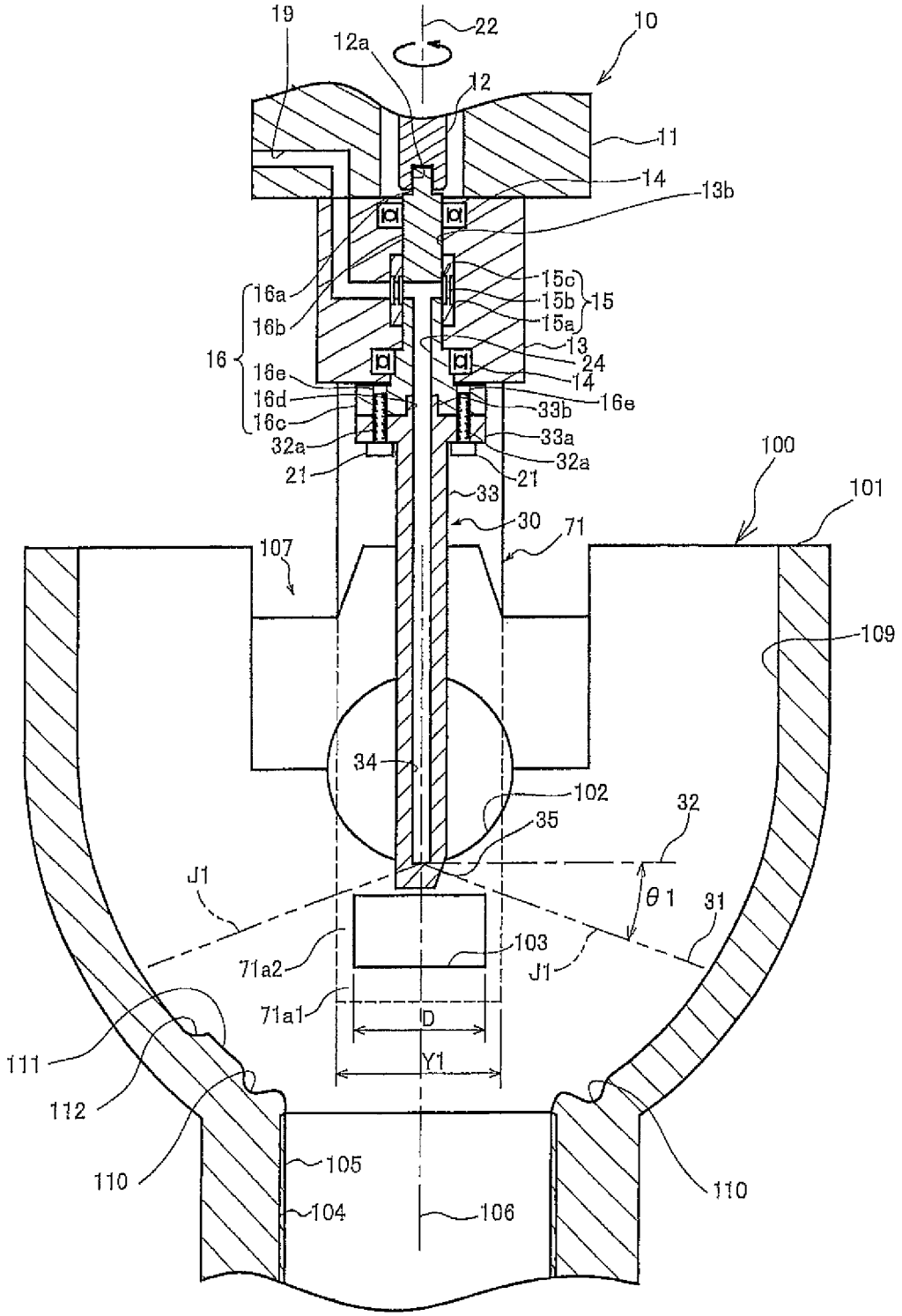
FIG. 2 is a sectional view taken along line II-II of FIG. 1.

Hereinafter, embodiments of the present invention will be described with reference to the accompanying drawings. The first embodiment shows an example of the removal of excess coatings adhering to the interior of a crank chamber of an in-line multi-cylinder engine. FIG. 1 is a longitudinal sectional view of an excess sprayed coating removal device 10 according to the first embodiment taken along a rotational axis 22 of a nozzle 30, with the nozzle 30 inserted in an inverted cylinder block 100. FIG. 2 is a sectional view taken along line II-II of FIG. 1. It should be noted that, in the following description, the "leading-end side" refers to the lower side in FIG. 1, and the "base-end side" refers to the upper side in FIG. 1.

The excess sprayed coating removal device 10 inserts the nozzle 30 into each of spaces (small chambers) 108 partitioned by partition walls 101 in a crank chamber 107, and removes excess sprayed coatings (not shown) adhering to the crank chamber 107 using a jet J1 discharged from a nozzle hole 35 of the nozzle 30.

The excess sprayed coating removal device 10 can be applied as part of a turret cleaning device. Cleaning devices, such as disclosed in Japanese Unexamined Patent Application Publication Nos. 2011-230118 and 2015-58479, can be used as the turret cleaning device.

The excess sprayed coating removal device 10 is equipped with a turret (spindle casing) 11 which is provided to an orthogonal three-axis moving device (not shown). The orthogonal three-axis moving device is controlled, for example, by a numerical control device. The interior of the turret 11 is provided with a rotatably-supported main spindle 12. The main spindle 12 is rotated about the rotational axis 22. A receiving portion 12*a* is provided at the leading end portion of the main spindle 12. The receiving portion 12*a* is formed in the shape of a U-section groove with its length in a direction to penetrate the drawing sheet. The receiving portion 12*a* is engaged with an engaging portion 16*a* of a nozzle supporting member 16 to be described later, and has the function of integrally rotating the nozzle supporting member 16 and the main spindle 12.

The turret 11 is provided with a cylindrical housing 13 about the rotational axis 22. The housing 13 is equipped with a cylindrical hole 13*b*. Bearings 14, packing 15 to be described later, and the nozzle supporting member 16 are inserted in the cylindrical hole 13*b*. The nozzle supporting member 16 is rotatably supported in the housing 13 by the bearings 14.

The nozzle supporting member 16 is composed of the engaging portion 16*a*, a shaft 16*b*, and a flange 16*c* of different diameters coaxially integrally provided, and is generally formed in an approximately cylindrical shape. The engaging portion 16*a* is double-chamfered or a key, both sides thereof being formed flat. Both flat surfaces of the engaging portion 16*a* are caught in the receiving portion 12*a* with a slight clearance therebetween. Thus, the nozzle supporting member 16 rotates in response to the rotation of the main spindle 12. The flange 16*c* is formed in a disk-like shape and has a receiving portion 16*d* and a threaded hole 16*e*. The receiving portion 16*d* is a cylindrical hole which fits a protruding portion 33*b* of the nozzle 30.

The cylindrical hole 13*b* is provided with the packing 15. The packing 15 is formed in a hollow cylindrical shape, and a circumferential groove 15*a* with rectangular section is provided in the center of the outer circumference thereof. A circumferential groove 15*c* with rectangular section is also provided in the center of the inner circumference of the packing 15. The packing 15 is provided with at least one through-hole 15*b* that provides communication between the circumferential groove 15*a* and the circumferential groove 15*c*. The packing 15 provides a seal between the housing 13 and the nozzle supporting member 16, and provides communication between flow paths 19 and 24 to be described later. The packing 15 can be made of engineering plastics or super engineering plastics.

A cleaning liquid supplying device 17 supplies cleaning liquid in the range of 10 to 80 MPa, preferably in the range of 30 to 50 MPa. Options of the cleaning liquid supplying device 17 can include a piston pump. The cleaning liquid supplying device 17 discharges the cleaning liquid retained in a cleaning liquid tank not shown. Alkaline or neutral water-soluble cleaning liquid or oily cleaning liquid is available as the cleaning liquid.

A valve 18 switches between the transmission and the interruption of the cleaning liquid from the cleaning liquid supplying device 17 to the turret 11. For example, a solenoid-operated cylinder valve can be used as the valve 18. The opening/closing of the valve 18 is automatically controlled, for example, by a numerical control device. The valve 18 can be configured as a flow path switching valve that returns the cleaning liquid to the cleaning liquid tank during the interruption of the cleaning liquid.

The flow path 19 is provided through the turret 11 and the housing 13. The flow path 19 is provided so as to communicate with the circumferential groove 15*a* of the packing 15. The flow path 24 is formed in T shape, and provided inside the nozzle supporting member 16. One end of the flow path 24 passes through the receiving portion 16*d*. The other end of the flow path 24 opens into the circumferential groove 15*c* of the packing 15. The flow path 19 and the flow path 24 are connected through the circumferential grooves 15*a* and 15*c* and the through-hole 15*b*. The circumferential grooves 15*a* and 15*c* circumferentially distribute the cleaning liquid.

The nozzle 30 is equipped with a flange 33*a* and a shaft body 33. The flange 33*a* is formed in a disk-like shape. The flange 33*a* is provided with through-holes 32*a* and the protruding portion 33*b*. The nozzle 30 is fixed to the flange 16*c* of the nozzle supporting member 16 by bolts 21 inserted in the through-holes 32*a*. The protruding portion 33*b* provided on the flange 33*a* is fitted and inserted in the receiving portion 16*d* of the nozzle supporting member 16. When the protruding portion 33*b* is fitted into the receiving portion 16*d* and the flange 33*a* and the flange 16*c* are brought into abutting relation, the nozzle 30 is accurately fixed to the nozzle supporting member 16.

It should be noted that the nozzle 30 can be configured in the shape of a rod without the flange 33*a* in place of the above-described configuration. In this case, the nozzle supporting member 16 is equipped with a collet in place of the flange 16*c*. Furthermore, the rod-shaped nozzle 30 may be fixed to the nozzle supporting member 16 by the collet.

The shaft body 33 is a rod-shaped body extending along the rotational axis 22, and preferably is formed in a spindly column shape. A flow path 34 is provided in the center of the shaft body 33. The flow path 34 extends to the vicinity of the leading end of the shaft body 33. The flow path 34 is connected to the flow path 24 of the nozzle supporting member 16.

The nozzle hole 35 is provided at the leading end portion of the shaft body 33 and is inclined toward the leading end side. The nozzle hole 35 communicates with the flow path 34. The installation angle of the nozzle 30, that is, the angle θ1 between a center axis 31 of the nozzle hole 35 and a horizontal axis 32 perpendicular to the rotational axis 22 of the nozzle 30, is set to the range of 10° to 25°. The reason why the angle θ1 is set in this range is that the angle θ1 allows the effective removal of excess sprayed coatings adhering to recessed portions 110 formed on the cylinder-bore 104 side in the crank chamber 107, and a stepped portion 112 (see FIG. 2), such as the periphery of an oil jet device mounting seat 111, and that the angle θ1 is a suitable angle for preventing the peeling-off of a sprayed coating 105 formed in a cylinder bore 104. It should be noted that the jet J1 discharged from the nozzle hole 35 appears in a cylindrical shape along the center axis 31. Here, the sectional shape of the shaft body 33 may be, for example, rectangular. In this case, the shaft body 33 is configured such that its center of gravity is coaxial with the rotational axis 22.

Furthermore, a pair of partition wall shields (shields) 71 and 72 are removably fixed to the turret 11 at positions symmetrical with respect to the rotational axis 22. When the turret 11 moves, the partition wall shields 71 and 72 also move integrally with the turret 11. Thus, when the nozzle 30 moves axially, the partition wall shields 71 and 72 also move in response to the movement of the nozzle 30.

The partition wall shield 71 is composed of: a shield plate 71*a* that receives the jet J1 from the nozzle hole 35 of the nozzle 30; and reinforcing plates 71*b* and 71*c* that reinforce the shield plate 71*a*. The shield plate 71*a* is a plate which is bent into an inverted L shape in the side view of the cylinder block 100 (FIG. 1). The shield plate 71*a* has a shape with a short side Y1 (see FIG. 2) larger than the width D of a communication hole 103 and a long side X1 exceeding the length of the nozzle 30, and is spaced apart from the nozzle 30 by a predetermined distance along the horizontal axis 32 of the nozzle 30.

Further, the shield plate 71*a* is provided at the leading end portion thereof with a bent leading end portion 71*a*1 that is bent to be directed toward the nozzle 30, and a block portion 71*a*2 impinging on the jet J1 and shutting the jet J1 is formed slightly further towards the base end (upper side) than the bent leading end portion 71*a*1. The block portion 71*a*2 is formed at a position of the shield plate 71*a* which faces the communication hole 103. This allows the shield plate 71*a* to cover, from the side of a space 108*a* adjacent to the space 108, the communication hole 103 provided in the partition wall 101 when the nozzle 30 is inserted to the vicinity of the lower end along a bore center 106 of the cylinder bore 104.

It should be noted that the bent leading end portions 71*a*1 and 71*a*2 are unnecessary depending on the conditions, such as the required pressure of the jet J1. Alternatively, the center of the shield plate 71*a* can be hollowed out in any portion except the block portion 71*a*2. Such hollowed-out portion allows a reduction in the weight of the shield plate 71*a*.

The block portion 71*a*2 is formed integrally with the shield plate 71*a* or 72*a*, and therefore has a simple configuration. The block portion 71*a*2 erodes due to jets impinging thereon. The block portion 71*a*2 may be formed in a tabular shape or may have a central portion raised toward the direction of the nozzle 30 in plan view. Furthermore, the surface of the block portion 71*a*2 may be configured so as to be inclined in such a manner that the distance from the nozzle 30 increases towards the leading end side. In this case, the jets impinging on the block portion 71*a*2 escape toward the leading end side of the nozzle 30, thereby spreading the amount of wear of the block portion 71*a*2 and achieving an increase in the lifetime of the block portion 71*a*2.

The block portion 71*a*2 may be fixed to the shield plate 71*a*, for example by a bolt. In this case, the shield plate 71*a* serves as a supporting member of the block portion 71*a*2. In this case, the shield plate 71*a* serving as the supporting member may be two beams provided parallel to the nozzle 30. It is unnecessary to provide the reinforcing plates 71*b* and 71*c*. The block portion 71*a*2 also may be configured so as to have a thickness more than the shield plate 71*a*. The block portion 71*a*2 may be configured from a laminated material composed of a plurality of layers.

The reinforcing plate 71*b* supports, from inside, a bent portion located at an upper portion of the shield plate 71*a*. The reinforcing plate 71*c* is provided outside the shield plate 71*a* in an elongated manner in a direction parallel to the nozzle 30. The reinforcing plates 71*b* and 71*c* are provided at the width center of the shield plate 71*a*, and prevent the shield plate 71*a* from being deformed under the dynamic pressure of the jet J1.

It should be noted that while the partition wall shield (shield) 72 is equipped with the shield plate 72*a* and reinforcing plates 72*b* and 72*c* and the shield plate 72*a*, and is formed with a bent leading end portion 72*a*1 and a block portion 72*a*2, they are of the same configuration as those of the partition wall shield 71. Thus the partition wall shield 72 will not be described here.

Next, the method for use of the excess sprayed coating removal device 10 configured in this manner and the advantageous effects thereof will be described.

The cylinder block 100 is the cylinder block of the in-line multi-cylinder engine. The cylinder block 100 is installed in an inverted manner with the cylinder head installation surface (not shown) facing downward in the vertical direction. The cylinder block 100 is equipped with the plurality of cylinder bores 104. The crank chamber 107 is partitioned into the spaces (small chambers) 108 by the partition walls 101 for each of the cylinder bores 104. The partition walls 101 are each provided with a journal hole 102 and the communication hole 103. The communication hole 103 is a so-called vent. The cylinder bores 104 of the cylinder block 100 are film-formed with the sprayed coating 105. At this time, excess sprayed coatings adhere to almost the entire inner surface of the crank chamber 107.

At the time of using the excess sprayed coating removal device 10, the cleaning liquid supplying device 17 is firstly operated. Then the main spindle 12 is rotated. The nozzle supporting member 16 and the nozzle 30 are rotated with the rotation of the main spindle 12. The rotational axis 22 of the nozzle 30 is positioned spacedly above the crank chamber 107 in an extension of the bore center 106 of the cylinder bore 104. The numerical control device switches the valve 18 to supply cleaning liquid to the turret 11. The cleaning liquid is supplied to the nozzle hole 35 through the valve 18, the flow path 19, the flow path 24, and the flow path 34 from the cleaning liquid supplying device 17. The cleaning liquid is discharged as the jet J1 from the nozzle hole 35.

When the turret 11 is moved downward along the bore center 106, the nozzle 30 is inserted into one (first small chamber) of the spaces 108, and the jet J1 impinges on the inner surfaces of a skirt 109 and the partition walls 101, which partition the space 108, and peels off the excess sprayed coatings adhering to the inner surfaces thereof. At this time, the cylinder block 100 may be either mounted with or without a crank cap.

When the turret 11 is moved further downward, the jet J1 passes through the communication holes 103 and goes toward cylinder bores 104*a* and 104*b* adjacent to the cylinder bore 104. However, since the partition wall shields 71 and 72 are inserted into the adjacent spaces 108*a* and 108*b* (second small chambers) with the space 108 and the partition walls 101 interposed therebetween, so as to cover the communication holes 103 in a manner facing the communication holes 103, the jet J1 impinges on the block portions 71*a*2 and 72*a*2 of the partition wall shields 71 and 72.

The jets J1 impinging on the block portions 71*a*2 and 72*a*2 change their respective flow directions along the surfaces of the shield plates 71*a* and 72*a*, and the kinetic energy is further attenuated by the bent leading end portions 71*a*1 and 71*a*2. Thus, the jets J1 do not peel off sprayed coatings 105*a* and 105*b* formed on the inner surfaces of the cylinder bores 104*a* and 104*b* adjacent to the cylinder bore 104.

Then, when the excess sprayed coating in the single space 108 is removed, the excess sprayed coating removal device 10 pulls the nozzle 30 upward, and repeats the same process to remove the excess sprayed coatings adhering to all spaces 108 in the crank chamber 107.

In this manner, the jet J1 is jetted in such a manner as to be slightly inclined toward the leading end side with respect to the horizontal axis 32, with the angle θ1 in the range of 10° to 25°. Thus, since the jet J1 also impinges precisely on the recessed portions 110 of the inner surface of the crank chamber 107, and the stepped portion 112, such as the periphery of the oil jet device mounting seat 111, it is possible to effectively remove the excess sprayed coatings adhering to the recessed portions 110 and the stepped portion 112, as compared with the case where the high-pressure water is jetted in a direction parallel to the horizontal axis 32 as in the related art. Furthermore, the jets J1 passing through the communication holes 103 are dammed by the partition wall shields 71 and 72, thereby preventing the jet J1 from peeling off the necessary sprayed coatings 105*a* and 105*b* formed on the cylinder bores 104*a* and 104*b* adjacent to the cylinder bore 104.

It should be noted that, if, in this embodiment, in addition to the nozzle 30, other nozzles such as a direct jet nozzle which jets cleaning liquid downward in the axial direction, and an L-nozzle which is equipped with an axially-extending shaft portion and a nozzle hole which jets cleaning liquid perpendicularly with respect to the axis from the leading end portion of the shaft portion, are fitted to the respective turret surfaces of the turret 11, and these nozzles are properly used, it is possible to more effectively remove the excess sprayed coatings adhering to the cylinder block 100.

Furthermore, it goes without saying that the excess sprayed coating removal device 10 of this embodiment is capable of removing the excess sprayed coatings in the same process in a horizontally-opposed multi-cylinder engine as well as in the cylinder block 100 of the in-line multi-cylinder engine. Further, although the above description has made with the cylinder block 100 in an inverted position, the orientation of the cylinder block 100 may of course be changed. Moreover, the excess sprayed coating removal device 10 has been described using the turret cleaning device, but also is applicable to the cleaning devices equipped with no turret.

Second Embodiment

Figure 3:
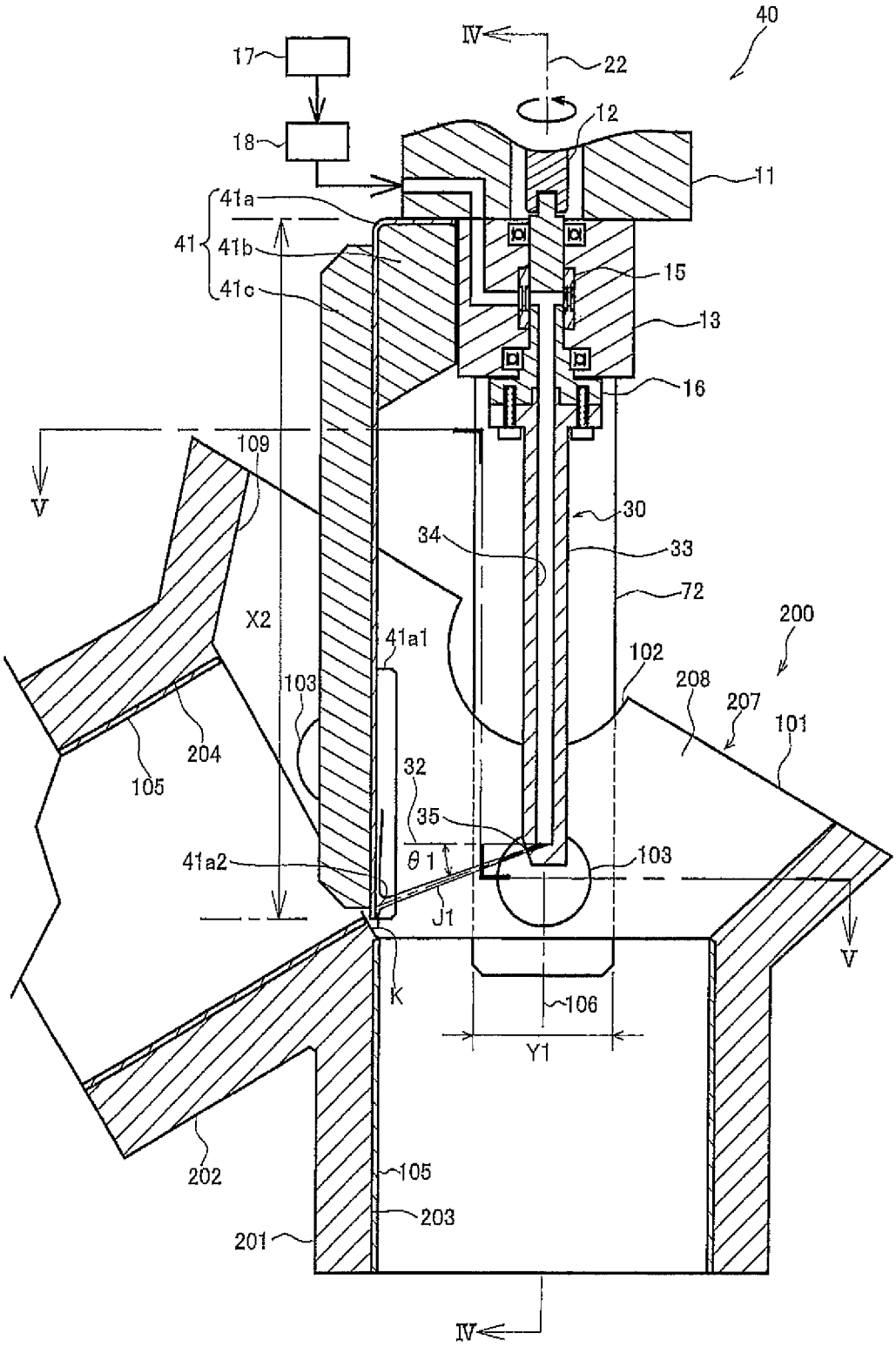
FIG. 3 is a sectional view showing the overall configuration of an excess sprayed coating removal device according to a second embodiment of the present invention.
Figure 4:
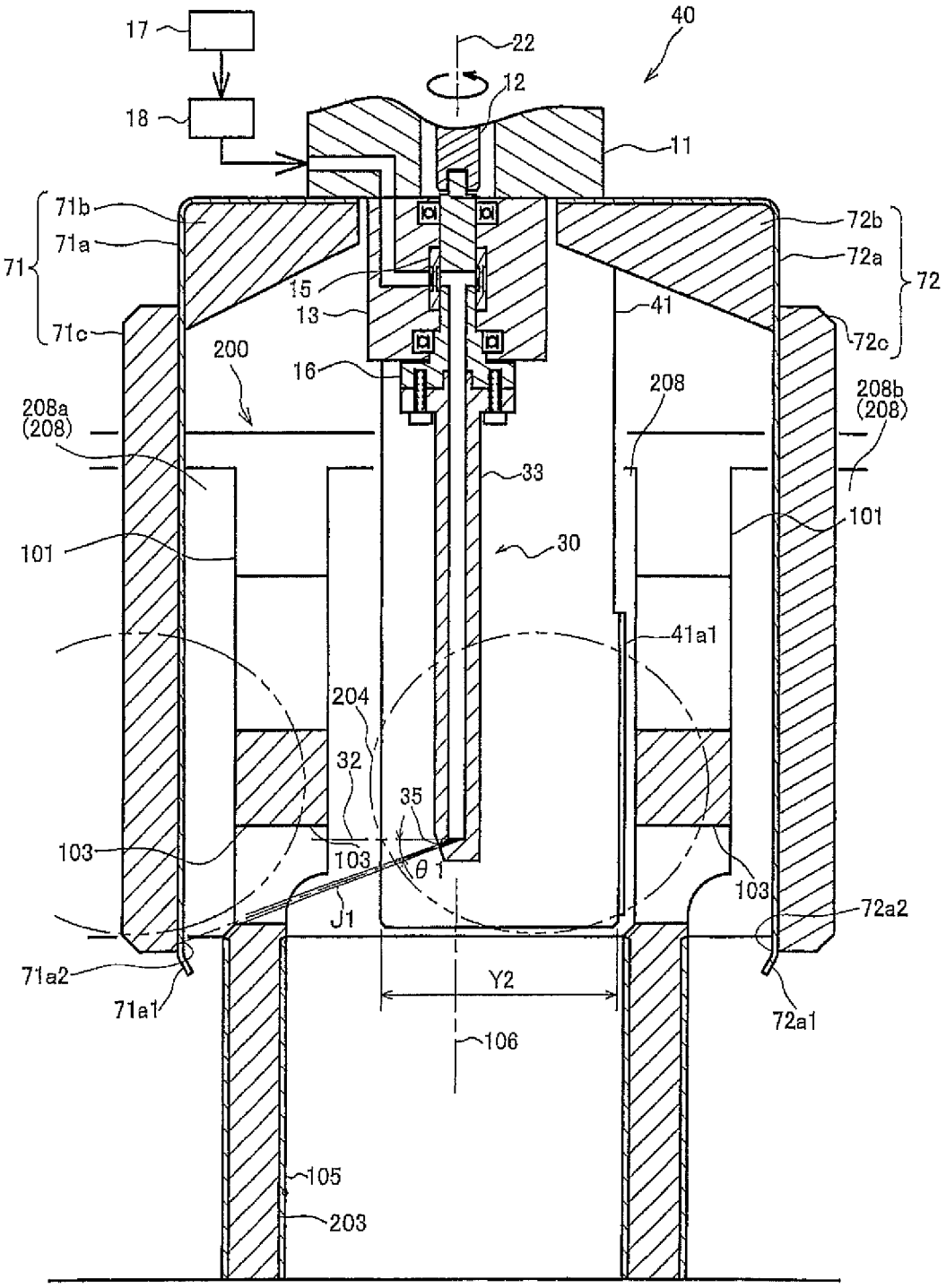
FIG. 4 is a sectional view taken along line IV-IV of FIG. 3.
Figure 5:
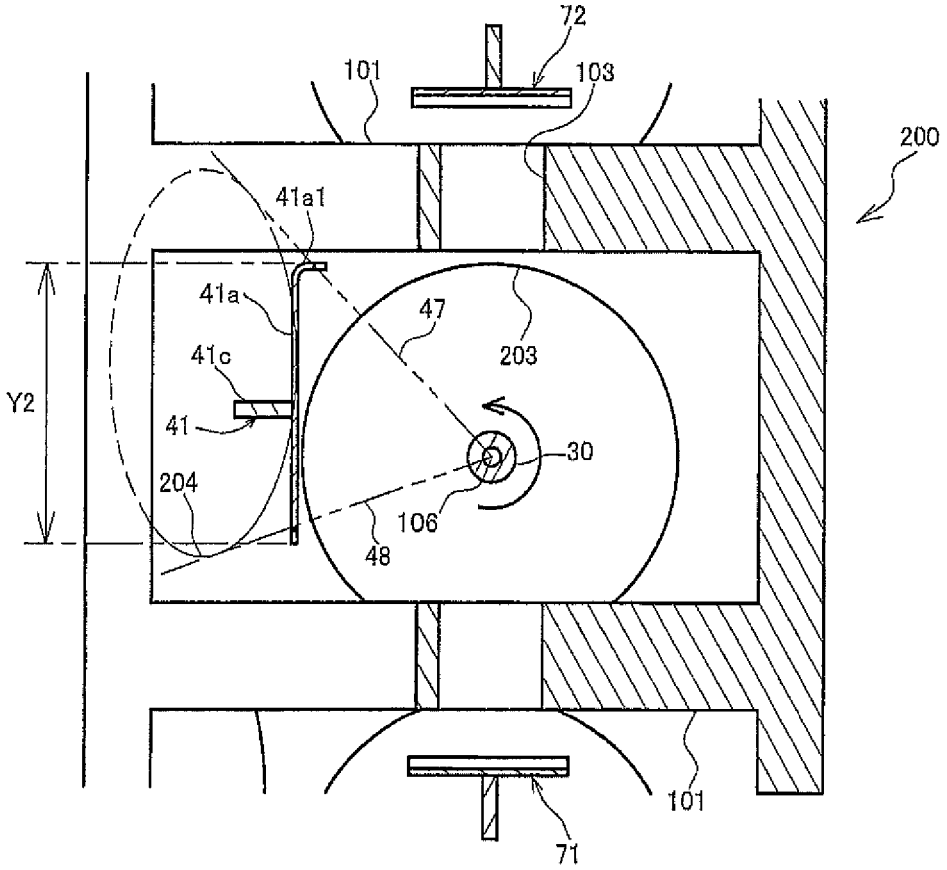
FIG. 5 is a sectional view taken along line V-V of FIG. 3.

A second embodiment will be described with reference to FIGS. 3 to 5. FIG. 3 is a longitudinal sectional view of an excess sprayed coating removal device 40 according to the second embodiment taken along the rotational axis 22 of the nozzle 30, with the nozzle 30 inserted in an inverted cylinder block 200. Furthermore, FIG. 4 is a sectional view taken along line IV-IV of FIG. 3, and FIG. 5 is a sectional view taken along line V-V of FIG. 3.

The excess sprayed coating removal device 40 according to the second embodiment is applied to the cylinder block 200 of a V-type multi-cylinder engine. A crank chamber 207 of the cylinder block 200 is partitioned by the partition walls 101 into spaces (small chambers) 208 which each accommodate cylinder bores 203 and 204 two by two provided in two banks 201 and 202, respectively, offset in phase. The cylinder bores 203 and 204 are provided so as to be offset longitudinally with respect to each other.

The excess sprayed coating removal device 40 has the turret (spindle casing) 11 that is equipped with the pair of partition wall shields (first shields) 71 and 72 and a bank shield (second shield) 41. For example, a shield unit of the present invention is composed of the pair of partition wall shields 71 and 72 and the bank shield 41. The pair of partition wall shields 71 and 72 and the bank shield 41 are removably fixed to the turret 11, and moved integrally with the turret 11. Thus, when the nozzle 30 moves axially, the partition wall shields 71 and 72 and the bank shield 41 also move in response to the movement of the nozzle 30. The partition wall shields 71 and 72 are arranged with a pitch of 180° with respect to the rotational direction of the nozzle 30. Furthermore, the bank shield 41 is disposed at a position offset in the rotational direction of the nozzle 30 from the partition wall shield 72 by 90° (see FIG. 5).

The partition wall shield 71 has the same configuration as that of the first embodiment, and is composed of the shield plate (first shield plate) 71*a*, and the reinforcing plates 71*b* and 71*c* that reinforce the shield plate 71*a*. The leading end portion of the shield plate 71*a* is formed with the block portion (first block portion) 71*a*2 that dams the jet J1, and the bent leading end portion 71*a*1 is provided further towards the leading end side than the block portion 71*a*2. Also, the partition wall shield 72 is configured in the same manner as the partition wall shield 71.

The excess sprayed coating removal device 40 is further equipped with a tilting device (not shown) that tilts the cylinder block 200. The portions other than the above are the same as those in the first embodiment. Therefore, these portions are denoted by the same reference signs as in the first embodiment, and the detailed description thereof will not be repeated.

The tilting device tilts the cylinder block 200 so that the cylinder bore 203 of one 201 of the banks faces downward in the vertical direction or the cylinder bore 204 of the other bank 202 faces downward in the vertical direction. A well-known tilting device (for example, a rotary table) can be used as the tilting device.

Referring to FIG. 3, the bank shield 41 is composed of: a shield plate (second shield plate) 41*a* that receives the jet J1 from the nozzle hole 35 of the nozzle 30; and reinforcing plates 41*b* and 41*c* that reinforce the shield plate 41*a*. The shield plate 41*a* is a plate bent into an inverted L shape when seen in the longitudinal direction (direction perpendicular to the drawing sheet of FIG. 3) of the cylinder block 200. The shield plate 41*a* has a shape with a short side Y2 (see FIG. 4) one-third or more the diameter of the cylinder bore 204 (the other cylinder bore) but less than the diameter of the cylinder bore 204 and a long side X2 exceeding the length of the nozzle 30, and is disposed at a position offset from the nozzle 30 by a distance almost equal to the radius of the cylinder bore 203 along the horizontal axis 32 of the nozzle 30.

When the nozzle 30 is inserted along the bore center 106, the length of the short side Y2 of the end of the shield plate 41*a* on the side (in the downward direction in FIG. 5) on which the cylinder bore 204 is not provided in the longitudinal direction of the engine is determined so as to reach at least the bore center 106 and a tangent 48 (see FIG. 5) to the cylinder bore 204.

With this configuration, when the nozzle 30 is inserted into the bore center 106, the shield plate 41*a* is located directly above the boundary K between the banks 201 and 202 (boundary between the one cylinder bore 203 and the other cylinder bore 204). Furthermore, the length of the shield plate 41*a* is set so that the shield plate 41*a* is prevented from making contact with the cylinder block 200 by leaving a slight gap therebetween when the nozzle 30 is inserted to the bottom end. Further, the leading end portion of the shield plate 41*a* is formed with a block portion (second block portion) 41*a*2 that dams the jet J1. It should be noted that the center of the shield plate 41*a* may be hollowed out in any portion except the block portion 41*a*2.

The block portion 41*a*2 is formed integrally with the shield plate 41*a*, and therefore has a simple configuration. The block portion 41*a*2 erodes due to jets impinging thereon. The block portion 41*a*2 may be formed in a tabular shape or may have a central portion raised toward the direction of the nozzle 30 in plan view. Furthermore, the surface of the block portion 41*a*2 may be configured so as to be inclined in such a manner that the distance from the nozzle 30 increases towards the leading end side. The block portion 41*a*2 may be fixed to the shield plate 41*a*, for example by a bolt. In this case, the shield plate 41*a* serves as a supporting member of the block portion 41*a*2. In this case, it is unnecessary to provide the reinforcing plates 41*b* and 41*c*. The block portion 41*a*2 also may be configured so as to have a thickness more than the shield plate 41*a*. The block portion 41*a*2 may be configured from a laminated material composed of a plurality of layers.

The reinforcing plate 41*b* supports, from inside, a bent portion located at an upper portion of the shield plate 41*a*. The reinforcing plate 41*c* is provided outside the shield plate 41*a* so as to be elongated in a direction parallel to the nozzle 30. The reinforcing plates 41*b* and 41*c* are provided at the width center of the shield plate 41*a* (see FIG. 5), and prevent the shield plate 41*a* from being deformed under the dynamic pressure of the jet J1.

Referring to FIGS. 3 and 5, a bent side portion 41*a*1 bent in the direction of the nozzle 30 is provided at one end in the longitudinal direction of the shield plate 41*a* on the side on which the cylinder bore 204 of the bank 202 is provided. When the nozzle 30 is positioned with respect to the bore center 106 of the cylinder bore 203, the bent side portion 41*a*1 has, in plan view, at least a height such that it reaches a tangent 47 to the cylinder bore 204 passing through the bore center 106 of the cylinder bore 203. At this time, preferably, the bent side portion 41*a*1 is provided as close to the partition wall 101 as possible. The bent side portion 41*a*1 prevents the jet J1 from impinging on the sprayed coating 105 provided on the inner surface of the cylinder bore 204. The leading end portion of the bent side portion 41*a*1 constitutes part of the block portion 41*a*2. It should be noted that the bent side portion 41*a*1 are unnecessary depending on the conditions, such as the required pressure of the jet J1.

Next, the method for use of the excess sprayed coating removal device 40 configured in this manner and the advantageous effects thereof will be described. The tilting device tilts the cylinder block 200 so that the cylinder bore 203 faces downward.

Then the nozzle 30 rotating while jetting cleaning nozzle is inserted into the space 208 (first small chamber) to remove the excess sprayed coatings adhering to the inner surface of the space 208 while moving the nozzle 30 downward along the bore centers 106 of all cylinder bores 203 (one cylinder bore) associated with the bank 201. At this time, the bank shield 41 is located so as to face the opening of the cylinder bore 204 (the other cylinder bore) communicating with the space 208, and the block portion 41*a*2 formed at the leading end portion of the shield plate 41*a* dams the jet J1 so as to prevent the jet J1 from impinging on the inner surface of the cylinder bore 204.

It should be noted that, as shown in FIG. 4, the partition wall shield 71 is inserted in a space 208*a* (second small chamber) adjacent to the space 208, and the partition wall shield 72 is inserted in a space 208*b* (second small chamber) adjacent to the space 208, so that the jet J1 passing through the communication hole 103 is dammed by the partition wall shields 71 and 72 as already described in the first embodiment.

Then the tilting device tilts the cylinder block 200 so that the cylinder bore 204 faces downward. At this time, the mounting position of the bank shield 41 to the turret 11 is moved by 180° in the rotational direction of the nozzle 30.

Alternatively, in FIG. 5, another turret 11 having a configuration in which the bank shield 41 is rotated 180° may be prepared in advance so that the turret 11 of the configuration shown in FIG. 5 is used when removing the excess sprayed coatings with the cylinder bore 203 facing downward, and another turret 11 in which the bank shield 41 is mounted opposite that shown in FIG. 5 is used when removing the excess sprayed coatings with the cylinder bore 204 facing downward.

Then, in the same manner as above, the nozzle 30 rotating while jetting cleaning nozzle is inserted into the space 208 to remove the excess sprayed coatings still remaining in the space 208 while moving the nozzle 30 downward along the bore centers of all cylinder bores 204 associated with the bank 202. At this time, the bank shield 41 dams the jet J1 so as to prevent the sprayed coating 105 on the inner surface of the cylinder bores 203 from peeling off. Thus, also in the case of the V-type multi-cylinder engine, the excess sprayed coating removal device 40 allows the reliable removal of the excess sprayed coatings in the crank chamber 207 without peeling off the strayed coatings 105 formed in the cylinder bores.

It should be noted that in the above description, the case where the mounting position of the bank shield 41 is changed between the banks 201 and 202, or the case where the separate turrets 11 for the bank 201 and the bank 202 are prepared in advance for use has been given as an example. However, alternatively, a turning device for turning the cylinder block 200 through 180° in plan view may be provided. In this case, the position of the cylinder bore 204 with respect to the cylinder bore 203 before turning, and the position of the cylinder bore 203 with respect to the cylinder bore 204 when the cylinder block 200 is turned 180° and tilted are the same. Thus, the combination of the nozzle 30 and the bank shield 41 is applicable to the bank 201 and the bank 202 in common. Furthermore, two excess sprayed coating removal devices 40 may be provided so that one of the excess sprayed coating removal devices 40 processes one bank (for example, the right bank) and the other excess sprayed coating removal device 40 processes the other bank (for example, the left bank). In addition, the arrangement may be such that the single turret 11 is mounted with a pair of bank shields 41 arranged with a pitch of 180°.

Third Embodiment

Figure 6:
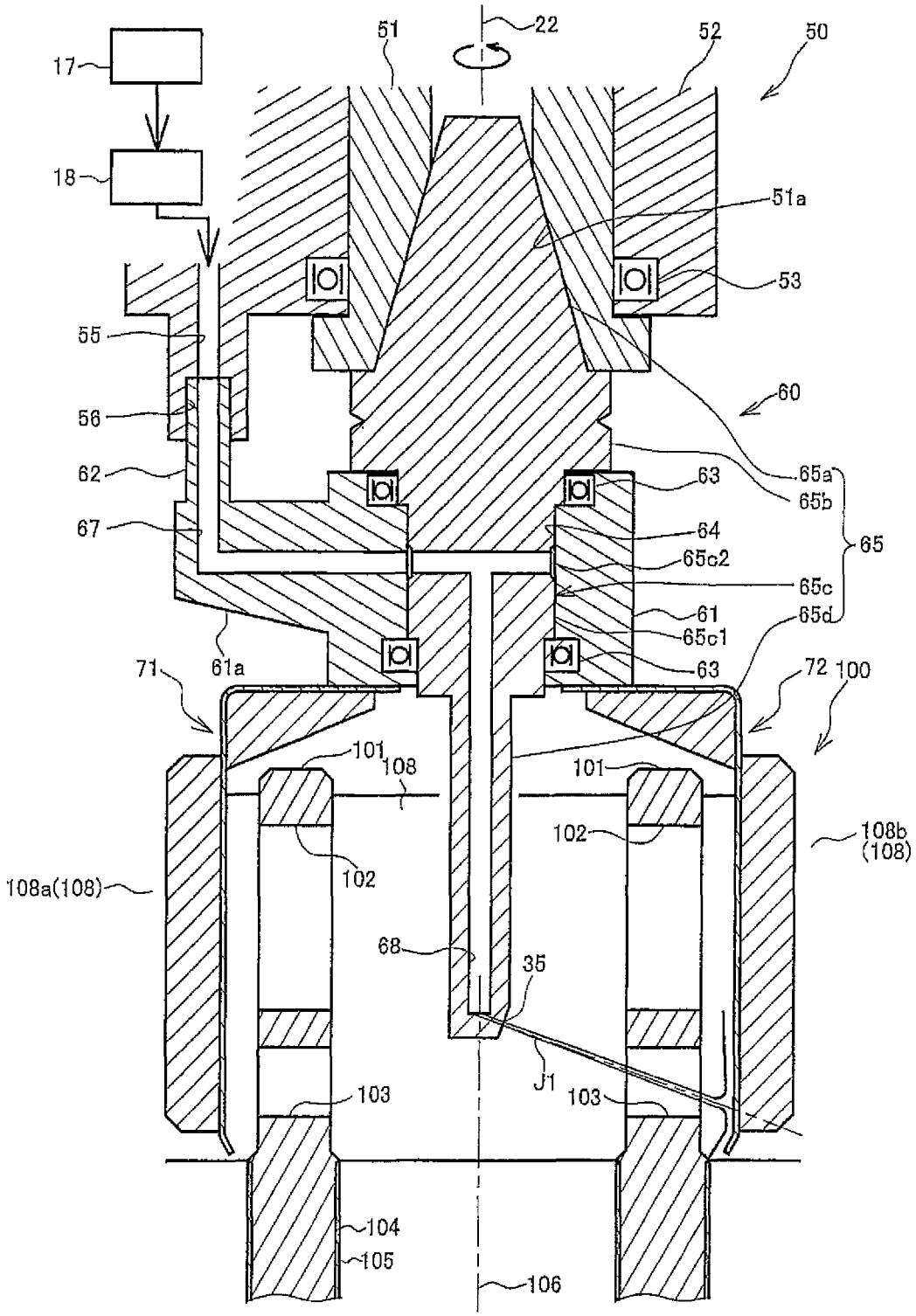
FIG. 6 is a sectional view showing the overall configuration of an excess sprayed coating removal device according to a third embodiment of the present invention.

A third embodiment will be described with reference to FIG. 6. FIG. 6 is a longitudinal sectional view of an excess sprayed coating removal device 50 according to the third embodiment taken along the rotational axis 22 of a nozzle 60, with the nozzle 60 inserted in the inverted cylinder block 100.

The third embodiment differs from the excess sprayed coating removal device 10 of the first embodiment in that an automatic-tool-changing cleaning machine is used. The automatic-tool-changing cleaning machine has a general structure similar to a machining center. However, while the machining center is used for cutting, the automatic-tool-changing cleaning machine is used for cleaning or deburring using jets. Furthermore, the high-pressure cleaning liquid in the range of 10 to 80 MPa is supplied to the main spindle. Therefore, although the machining center and the automatic-tool-changing cleaning machine differ from each other mainly in accuracy, mechanical stiffness, and mildew resistance, the major structures thereof are the same. Under such circumstances, differences from the first embodiment will be described in detail in the following description, in which like reference signs denote like portions and the description thereof is omitted.

In the excess sprayed coating removal device 50, a main spindle 51 with a shank hole 51*a* is rotatably supported by a bearing 53 in a main spindle head (spindle casing) 52 provided to an orthogonal three-axis moving device. The main spindle head 52 is provided with a detent hole 56 adjacent to the shank hole 51*a*. The main spindle head 52 is provided with a flow path 55 opening into the detent hole 56. The detent hole 56 is provided with packing (not shown) for sealing the detent hole 56 with respect to an insertion portion 62.

The nozzle 60 is replaced by means of an automatic tool changing device not shown. The nozzle 60 is equipped with: a body 61; a rotor 65 that journaled to the body 61; and flow paths 67 and 68 that supplies cleaning liquid to the interior of the rotor 65 from the detent hole 56.

The body 61 has a general cylindrical shape, and the abdomen of the body 61 is equipped with a protruding portion 61*a*. The protruding portion 61*a* is equipped with the insertion portion 62 that is inserted into the detent hole 56. When the nozzle 60 is installed in the main spindle 51, the insertion portion 62 is fitted and inserted into the detent hole 56. A cylindrical hole 64, which is a stepped through-hole, is provided in the center of the body 61. Bearings 63 are provided at either end of the cylindrical hole 64.

The rotor 65 includes a taper shank 65*a*, a flange 65*b*, a cylindrical portion 65*c*, and a shaft body 65*d* integrally molded. The taper shank 65*a* is equipped with a conic surface in close contact with the shank hole 51*a*. When the taper shank 65*a* and the shank hole 51*a* are brought into close contact with each other, the nozzle 60 is installed in the main spindle 51. At this time, since the insertion portion 62 is inserted into the detent hole 56, the body 61 does not rotate. The flange 65*b* is formed in a disk-like shape. The cylindrical portion 65*c* is equipped with a cylindrical surface 65*c*1 for sliding against the cylindrical hole 64. The cylindrical surface 65*c*1 is provided with a circumferential groove 65*c*2. Both ends of the cylindrical portion 65*c* are supported by the bearings 63. The shaft body 65*d* corresponds to the nozzle 30 in the first embodiment, and therefore the detailed description thereof is omitted.

The flow path 67 is provided between the insertion portion 62 of the body 61 and the cylindrical hole 64. The flow path 67 opens into the circumferential groove 65*c*2 of the rotor 65. The flow path 68 is provided inside the rotor 65. The flow path 68 is of T-shape, which is composed of: a through-hole that has both ends opening into the circumferential groove 65*c*2; and a vertical hole that is provided along the center axis of the shaft body 65*d*. The flow path 67 and the flow path 68 communicate with each other through the circumferential groove 65*c*2. The circumferential groove 65*c*2 circumferentially evenly distributes the cleaning liquid supplied from the flow path 67, and continuously supplies cleaning liquid to the nozzle hole 35 even if the rotational direction of the rotor 65 is changed. The nozzle hole 35 communicates with the flow path 68. Furthermore, when the nozzle 60 is installed in the main spindle 51, the flow path 67 communicates with the flow path 55. The cleaning liquid supplied from the cleaning liquid supplying device 17 passes through the flow paths 55, 67, and 68 and is discharged as the jet J1 from the nozzle hole 35.

The partition wall shields 71 and 72 are fixed to the body 61 of the nozzle 60. When the nozzle 60 is replaced by means of the automatic tool changing device, the partition wall shields 71 and 72 are removed from the cleaning region together with the nozzle 60. Therefore, when a nozzle different from the nozzle 60 is installed in the main spindle 51, the partition wall shields 71 and 72 do not interfere with the replaced nozzle.

It should be noted that the partition wall shields 71 and 72 may be fixed to the main spindle head 52. When the partition wall shields 71 and 72 are fixed to the main spindle head 52, the structures of the mounting portions of the partition wall shields 71 and 72 may optionally be changed so as not to interfere with the nozzle and changing arm at the time of automatic tool changing. Also with this configuration, it is possible to reliably remove the excess sprayed coatings adhering to the inner surface of the crank chamber 107 while protecting the sprayed coatings 105 formed in the cylinder bores 104. At this time, there may be further provided a moving mechanism for moving the partition wall shields 71 and 72 as needed to the retreat position where the partition wall shields 71 and 72 do not interfere with the changing arm and the nozzle.

It should be understood that the present invention is not limited to the above-described embodiments and various changes can be made without departing from the gist of the invention, and that all technical matters included in the technical ideas set forth in the appended claims become the subject of the invention. While the above-described embodiments show preferred examples, a person skilled in the art may implement various alternatives, amendments, modifications, or improvements from the contents disclosed herein, which are included in the technical scope set forth in the appended claims.

For example, the shield plate 41*a* of the bank shield 41 or the shape of the shield plates 71*a* and 72*a* of the partition wall shields 71 and 72 may be formed not only in a flat plate-like body, but also for example in a halfpipe-shaped curved surface, a surface having recesses and protrusions, or a wavy surface. Furthermore, in place of the configuration in which the bank shield 41 and the partition wall shields 71 and 72 are mounted to the turret 11, the arrangement may be such that each shield is fixed to an articulated arm or the like which operates simultaneously with the operation of the turret 11, and moves in the axial direction of the nozzle 30. Further, while in the above-described embodiments, the orthogonal three-axis moving device is used to move the turret 11, a vertical articulated robot or parallel link robot may, alternatively, be used.

What is claimed is:

1. An excess sprayed coating removal device for removing excess sprayed coatings adhering to an inner surface of a crank chamber of a multi-cylinder engine, the excess sprayed coating removal device comprising:

a rotatable nozzle configured to be inserted into the crank chamber of the multi-cylinder engine, the nozzle being movable in a direction parallel to an axial direction of a cylinder bore of the multi-cylinder engine and configured to jet high-pressure water from a leading end side of the nozzle; and at least one shield configured to protect the cylinder bore from the high-pressure water while the nozzle is inserted into the crank chamber, the at least one shield having a block portion intersecting a central axis of the high-pressure water jetted from the leading end side of the nozzle, the block portion being configured to block the high-pressure water that is jetted from the nozzle and which passes through a communication hole of the multi-cylinder engine.

2. The excess sprayed coating removal device according to claim 1, further comprising:

a spindle casing configured to rotatably support the nozzle, wherein the at least one shield is fixed to the spindle casing and is configured to move in an axial direction of the nozzle and move integrally with the nozzle.

3. The excess sprayed coating removal device according to claim 1, wherein:

the at least one shield has a shield plate disposed to be spaced apart from the nozzle in a direction perpendicular to an axial direction of the nozzle, the shield plate being formed with the block portion disposed at a leading end side of the shield plate, and the shield plate has a bent leading end portion bent in a direction facing the nozzle, the bent leading end portion being disposed closer to a side of the leading end side of the nozzle than a side of the block portion of the shield plate.

4. The excess sprayed coating removal device according to claim 3, wherein the nozzle is inclined such that the central axis of the high-pressure water jetted from the leading end side of the nozzle is inclined toward the leading end side of the shield plate at an angle having a range of 10° to 25° with respect to a direction perpendicular to an axial direction of the nozzle.

5. The excess sprayed coating removal device according to claim 2, wherein:

the at least one shield has a shield plate disposed to be spaced apart from the nozzle in a direction perpendicular to the axial direction of the nozzle, the shield plate being formed with the block portion disposed at a leading end side of the shield plate; and the shield plate has a bent leading end portion bent in a direction facing the nozzle, the bent leading end portion being disposed closer to the leading end side of the nozzle than the block portion.

6. The excess sprayed coating removal device according to claim 2, wherein the nozzle is inclined such that the central axis of the high-pressure water jetted from the leading end side of the nozzle is inclined toward the leading end side at an angle having a range of 10° to 25° with respect to a direction perpendicular to the axial direction of the nozzle.

7. The excess sprayed coating removal device according to claim 3, wherein the nozzle is inclined such that the central axis of the high-pressure water jetted from the leading end side of the nozzle is inclined toward the leading end side at an angle having a range of 10° to 25° with respect to a direction perpendicular to the axial direction of the nozzle.

8. The excess sprayed coating removal device according to claim 5, wherein the nozzle is inclined such that the central axis of the high-pressure water jetted from the leading end side of the nozzle is inclined toward the leading end side at an angle having a range of 10° to 25° with respect to the direction perpendicular to the axial direction of the nozzle.

9. An excess sprayed coating removal device for removing excess sprayed coatings adhering to an inner surface of a crank chamber of a multi-cylinder engine, the excess sprayed coating removal device comprising:

a rotatable nozzle configured to be inserted into a first cylinder bore of the multi-cylinder engine, the nozzle being movable in a direction parallel to an axial direction of the first cylinder bore and configured to jet high-pressure water from a leading end side of the nozzle;

at least one first shield configured to protect the first cylinder bore from the high-pressure water sprayed from the nozzle; and a second shield configured to be inserted into a chamber of a second cylinder bore different from the first cylinder bore through which the nozzle is inserted, and protect the second cylinder bore from the high-pressure water sprayed on an inner surface of the first cylinder bore, wherein:

the at least one first shield has a first block portion intersecting a central axis of the high-pressure water jetted from the leading end side of the nozzle, the first block portion being configured to block the high-pressure water jetted from the nozzle and which passes through a communication hole of the multi-cylinder engine; and the second shield has a second block portion configured to block the high-pressure water jetted from the nozzle.

10. The excess sprayed coating removal device according to claim 9, further comprising:

a spindle casing configured to rotatably support the nozzle, wherein the at least one first shield and the second shield are fixed to the spindle casing and configured to move in an axial direction of the nozzle and integrally with the nozzle.

11. The excess sprayed coating removal device according to claim 9, wherein:

the at least one first shield has a first shield plate disposed to be spaced apart from the nozzle in a direction perpendicular to an axial direction of the nozzle, the first shield plate being formed with the first block portion disposed at a leading end side of the first shield plate;

the second shield has a second shield plate disposed to be spaced apart from the nozzle in a direction perpendicular to the axial direction of the nozzle and spaced apart from the at least one first shield in a rotational direction of the nozzle, the second shield plate being formed with the second block portion disposed at a leading end side of the second shield plate; and the second shield plate has a bent side portion bent in a direction facing the nozzle, the bent side portion being disposed at a side end portion of the second shield plate in a direction from the first cylinder bore to the second cylinder bore in a longitudinal direction of the engine, the second shield plate being disposed at a boundary between the first cylinder bore and the second cylinder bore.

12. The excess sprayed coating removal device according to claim 10, wherein:

the at least one first shield has a first shield plate disposed to be spaced apart from the nozzle in a direction perpendicular to the axial direction of the nozzle, the first shield plate being formed with the first block portion disposed toward a leading end side of the first shield plate;

the second shield has a second shield plate disposed to be spaced apart from the nozzle in the direction perpendicular to the axial direction of the nozzle and spaced apart from the at least one first shield in a rotational direction of the nozzle, the second shield plate being formed with the second block portion disposed at a leading end side of the second shield plate; and the second shield plate has a bent side portion bent in a direction facing the nozzle, the bent side portion being configured to be disposed at a side end portion of the second shield plate in a direction from the first cylinder bore to the second cylinder bore in a longitudinal direction of the multi-cylinder engine, the second shield plate being configured to be disposed at a boundary between the first cylinder bore and the second cylinder bore.

13. The excess sprayed coating removal device according to claim 9, wherein the nozzle is inclined such that the central axis of the high-pressure water jetted from the leading end side of the nozzle is inclined toward the leading end side at an angle having a range of 10° to 25° with respect to a direction perpendicular to the axial direction of the nozzle.

14. The excess sprayed coating removal device according to claim 10, wherein the nozzle is inclined such that the central axis of the high-pressure water jetted from the leading end side of the nozzle is inclined toward the leading end side at an angle having a range of 10° to 25° with respect to a direction perpendicular to the axial direction of the nozzle.

15. The excess sprayed coating removal device according to claim 11, wherein the nozzle is inclined such that the central axis of the high-pressure water jetted from the leading end side of the nozzle is inclined toward the leading end side at an angle having a range of 10° to 25° with respect to the direction perpendicular to the axial direction of the nozzle.

16. The excess sprayed coating removal device according to claim 12, wherein the nozzle is inclined such that the central axis of the high-pressure water jetted from the leading end side of the nozzle is inclined toward the leading end side at an angle having a range of 10° to 25° with respect to the direction perpendicular to the axial direction of the nozzle.

17. An excess sprayed coating removal device for removing excess sprayed coatings adhering to an inner surface of a crank chamber of a multi-cylinder engine, the excess sprayed coating removal device comprising:

a rotatable nozzle configured to be inserted the crank chamber of the multi-cylinder engine, the nozzle being movable in a direction parallel to an axial direction of a first cylinder bore of the multi-cylinder engine and configured to jet high-pressure water from a leading end side of the nozzle;

at least one first shield configured to protect the first cylinder bore of the multi-cylinder engine from the high-pressure water while the nozzle is inserted into the crank chamber, the at least one first shield having a first block portion intersecting a central axis of the high-pressure water jetted from the leading end side of the nozzle, the first block portion being configured to block the high-pressure water that is jetted from the nozzle and which passes through a communication hole of the multi-cylinder engine; and a second shield configured to protect a second cylinder bore of the multi-cylinder engine from the high-pressure water while the nozzle is inserted into the crank chamber, the second shield having a second block portion configured to block the high-pressure water jetted from the nozzle.

* * * * *